US005889454A

United States Patent [19]

Hendel

[11] Patent Number: 5,889,454

[45] Date of Patent: Mar. 30, 1999

[54] ELECTROMAGNETIC RELAY AND METHOD OF MANUFACTURE THEREOF

[75] Inventor: Horst Hendel, Berlin, Germany

[73] Assignee: Siemens Aktiengesellschaft, Munich, Germany

[21] Appl. No.: 727,887

[22] Filed: Oct. 9, 1996

[30] Foreign Application Priority Data

Oct. 9, 1995 [DE] Germany ..... 195 37 613.7

[51] Int. Cl.[6] ..... H01H 9/00

[52] U.S. Cl. ..... 335/177; 335/78; 335/85; 335/267; 335/268

[58] Field of Search ..... 335/78–86, 85, 335/128, 202, 267, 268, 177–179, 281

[56] References Cited

U.S. PATENT DOCUMENTS 5,239,281 8/1993 Tomono et al. ..... 335/78

FOREIGN PATENT DOCUMENTS 924 873 3/1955 Germany .

6908276 2/1969 Germany .

38 43 359 C2 7/1989 Germany .

42 33 807 A1 4/1993 Germany .

42 44 247 A1 7/1994 Germany .

*Primary Examiner*—Michael L. Gellner

*Assistant Examiner*—Raymond M. Barrera

*Attorney, Agent, or Firm*—Hill & Simpson

[57] ABSTRACT

An electromagnetic relay and methods for its manufacture are provided. The relay has a coil body with flanges and with at least one winding disposed between the flanges. A rod-shaped core is respectively arranged axially inside each winding. The yoke is secured against motion in the longitudinal direction and against pivotal movement in a coil flange by mounting elements. In addition, the first end of the core is connected on the side surface of the first yoke leg by welding or soldering. A double relay with first yoke legs disposed next to each other in parallel fashion is preferably created, whereby the core-yoke connection is produced in a simple manner and a good magnetic transition is ensured.

13 Claims, 4 Drawing Sheets

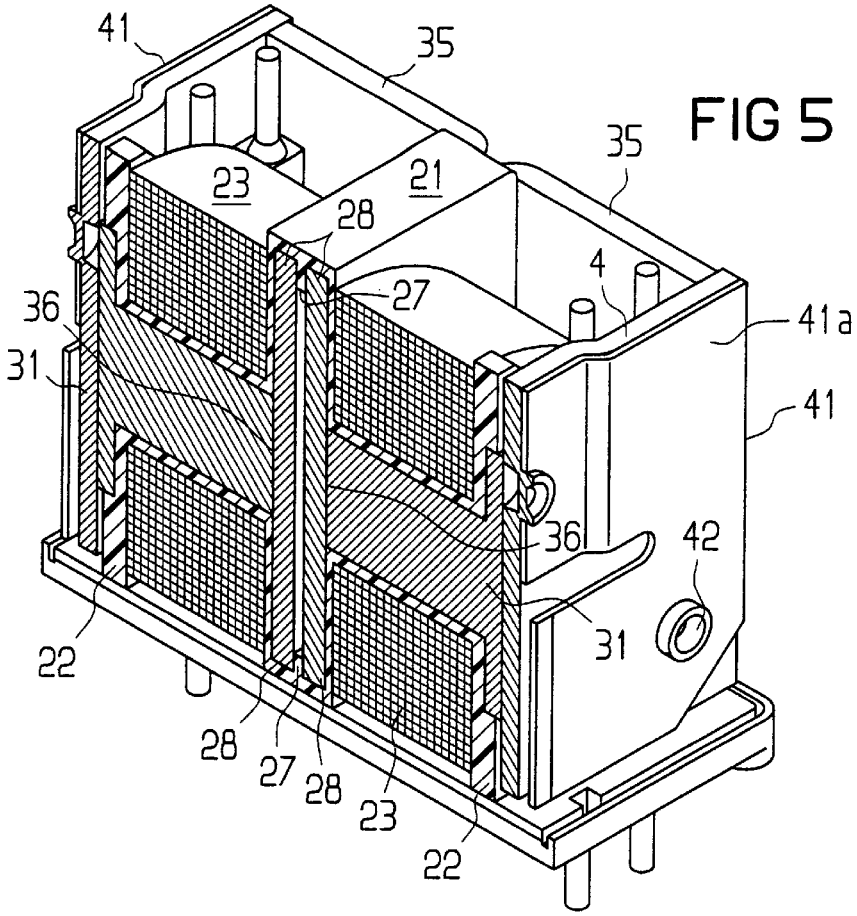
FIG 5
FIG 6
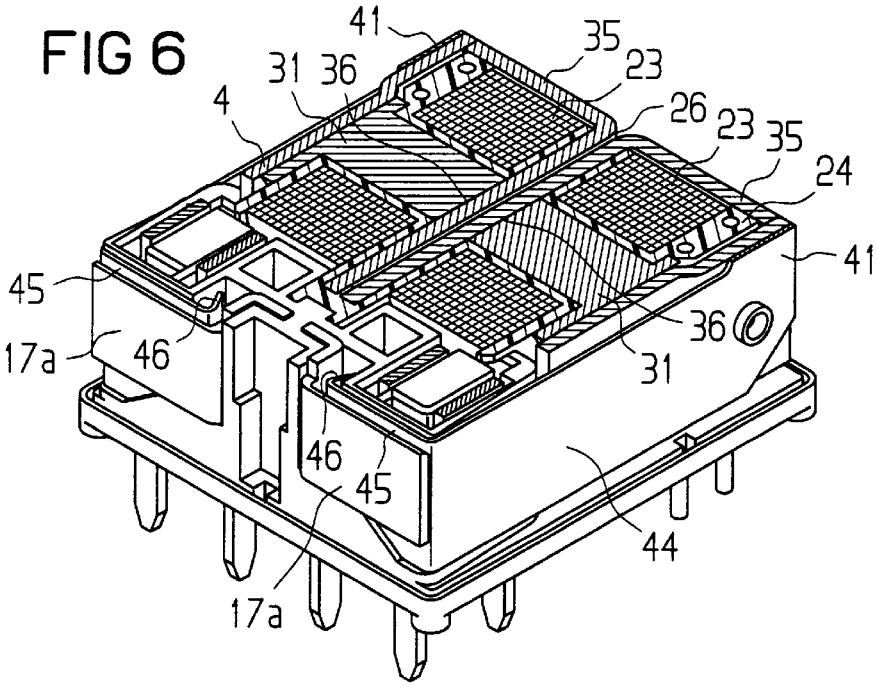

ELECTROMAGNETIC RELAY AND METHOD OF MANUFACTURE THEREOF

BACKGROUND OF THE INVENTION

Field of the Invention

The present invention is related to electromagnetic relays and the manufacture of such relays.

Description of the Prior Art

Electromagnetic relays which include a coil, a core axially disposed within the coil, a yoke connecting the core to an armature and a contact spring with a movable contact and a leg contacting the armature to a fixed contact are commonly known and may be constructed as single or double relays (see, e.g., DE 42 33 807 A1, DE 38 43 359 C2). The connection between the core and the first yoke leg usually requires in that the core be inserted into a bored hole through the yoke leg and then fixed thereto by caulking, by welding, or in some other attachment method. However, when caulking or welding is required, the point of connection between the yoke leg and the core must be accessible for the engagement of large mounting devices and tools. Further, for miniaturized designs, the yoke is made of a thin material so that the maximum available surface area for bonding with the core is only as thick as the thickness of the yoke itself. Accordingly, the bond between the core and the yoke is prone to breakage during manufacture as well as subsequent use.

Further, in double relays, the manufacture of two individual magnet systems with separate coils, cores and yokes is required. The coils, cores and yokes are then subsequently connected to form the double relay. Thus, for double relays, it is not possible to provide a common coil body for two magnet systems with both windings in one work operation. Therefore, it is not possible to simultaneously mount the magnetic circuit with yokes and cores in such a double coil and, accordingly, double relays are relatively time consuming and expensive to manufacture.

Another problem encountered in the manufacture of relays of the above-described type is that the connection point between the core and the yoke presents a magnetic resistance in the magnetic circuit. The resulting magnetic resistance increases in magnitude with the increasing miniaturization of the overall system and with the associated reduction of the thickness of the materials used for the yoke and the core. Thus, on the one hand, it is important for the connection of the material between the core and the yoke be as good as possible and also that it be maintained over the life span of the relay so that the connection is not loosened by external forces acting on the yoke. On the other hand, the coupling surface between the end of the core and an annular recess in the yoke limb becomes increasingly smaller as the thickness of the material of the yoke becomes smaller. Given a yoke lamination thickness of less than 1 mm, this coupling surface in a bored hole in a yoke presents a considerable magnetic resistance, even given a good connection of the two parts.

Thus, there is a need for a relay of the type described above, and a method for the connection between the core and the yoke, whereby a good mechanical and magnetic coupling between the core and the yoke is enabled in a simplified fashion, even with thin materials. Further, the coupling should also be neither negatively affected nor destroyed by the effect of external mechanical forces on the yoke. The connection between the core and the yoke should be producible both in an individual relay and in a double relay without particular difficulty, even when the connection point is not externally accessible for the engagement of larger tools.

SUMMARY OF THE INVENTION

According to the invention, the above needs are met in a relay of the type named above in that the first yoke leg in the first coil flange is secured against motion in the axial direction, and against swinging, by means of mounting elements, and in that the inner end or first end of the core meets the side surface of the first yoke leg, and is connected with the yoke leg, via its inner end surface only.

Thus, in the construction of the present invention, the bored hole in the first yoke leg for the reception of the end of the core is omitted. Instead, the entire frontal surface of the core is welded or soldered onto the side surface of the yoke leg. As a result, a larger coupling surface is provided between the core and the yoke than the previously standard yoke boring because the annular coupling surface between the core and the yoke with the bored hole becomes very small given a very small thickness of the material of the yoke. By means of the additional fixing of the yoke through mounting elements of the coil flange, it is ensured that the welded or soldered connection is of a good quality because the yoke is safely held in place and in a still position in the coil flange. Thus, external forces or vibrations cannot have a serious effect on the quality of the connection between the core and the yoke.

The mounting of the first yoke leg in the coil flange preferably consists in that the first yoke leg, with parallel side edges, being inserted in the manner of a drawer into the accommodating slot of the first coil flange. The yoke leg is substantially perpendicular to the coil axis. The yoke leg is thereby usefully held in place by the coil flange so that motion is possible only in the direction of insertion up to the stopping point.

The connection of the present invention between the core and the yoke is also advantageous in single relays, in particular with the use of fairly thin yoke laminations, e.g. having a thickness of less than 1 mm. However, a particular advantage results when two coil bodies, respectively having a winding, a core, a yoke and an armature, are constructed in mirror-image fashion and connected with one another in such a way that the coil axes are aligned with one another and the two first yoke limbs lie parallel on one another, while maintaining an insulating spacing. In this case, it is possible, in a particularly advantageous way, to fashion the two coil bodies by means of a one-piece double coil body, whereby a common first flange bears both the first yoke legs as a middle flange, and the two second legs sit on opposite sides of the relay base as end flanges. Since the two first yoke legs of a double relay of this type, with the corresponding core ends, are not accessible for another joining process, in this case, the inventive type of connection first makes possible a relay construction of a type in which the two windings can already be previously attached to a common coil body, and the two cores can subsequently be installed from two opposed sides in the double coil body. It is thereby also possible to use coils having enlarged pole plates, since the cores are inserted into the respective coil body from the armature side of the coil body.

A single relay of the present invention includes a coil body has a first flange and at least one second flange, whereby a winding is respectively arranged between the first and the second flange. A rod-shaped core is arranged in the coil body, axial to each winding. An angled-off yoke is respectively coupled with a first yoke leg in the region of the first coil flange at a first end of the core, while a second yoke leg extends parallel to the core next to the winding. A movable armature respectively connects the second yoke leg with the second end of the core so as to form a working air gap. And the armature actuates at least one contact spring, which in turn works together with at least one fixed contact.

Further, a method for the manufacture of an inventive relay essentially comprises the following steps:

a) the yoke is respectively inserted a slot in the first coil flange with its first yoke leg perpendicular to the coil axis;

b) the respective core is inserted into the coil body in the axial direction until the frontal surface of its first end meets the side surface of the first yoke leg; and c) through the application of a voltage between the yoke and the core, the two elements are non-positively connected at their point of contact by means of resistance heating. This method can also be used analogously for the mentioned double relay, whereby in this case the two first yoke legs are inserted in parallel fashion into corresponding grooves of the middle flange, and, preferably, these two first yoke limbs are commonly set to a first welding potential by means of an interposed contacting plate, while the two cores are connected in parallel fashion to a second welding potential. In this way, the two core-yoke connections can be produced at the same time. The welding current is adjusted so that a hard soldering results between the respective core and the respective yoke, whereby the connection is formed by a surface coating of the parts with copper, silver or another hard soldering material.

Further, no additional expense thereby essentially arises, since in any case the iron parts are normally coated with copper or the like as protection against corrosion. Any metel can thereby be used that alloys with iron and has a lower melting point than that of iron, thus e.g. about 1000° C. or lower. The thickness of the layer of the hard soldering material on the surface of the core or, respectively, of the yoke is normally between 4 and 6 $\mu$m. The mentioned contacting plate does not weld with the two yoke limbs, since it forms a very large contact surface with these; thus, it can be withdrawn from the middle flange without difficulty after the welding or, respectively, hard soldering.

Finally, it is also to be noted that a close magnetic coupling of the two switching systems also results by means of the arrangement of the two switching systems with cores aligned with one another and first yoke limbs arranged closely adjacent to one another, which arrangement becomes possible by means of the inventive type of core-yoke connection. This magnetic coupling can also be used during the operation of the double relay If, for example, the two exciter coils, or trip coils, are wound and excited so that the magnetic fluxes through both coils lie in series, the excitation of the one magnetic system also supports the operation of the other, so that the response security of the double relay is improved as a whole. In certain cases, the mutual influencing can also be exploited by means of correspondingly opposed excitation.

BRIEF DESCRIPTION OF THE DRAWINGS

In the following, the invention is explained in more detail by means of exemplary embodiments on the basis of the following drawings wherein:

FIG. 5 is a vertical sectional view through the relay of FIG. 1; and

FIG. 6 is a horizontal sectional view of the relay of FIG. 1.

DETAILED DESCRIPTION OF THE PRESENTLY PREFERRED EMBODIMENTS

Figure 1:
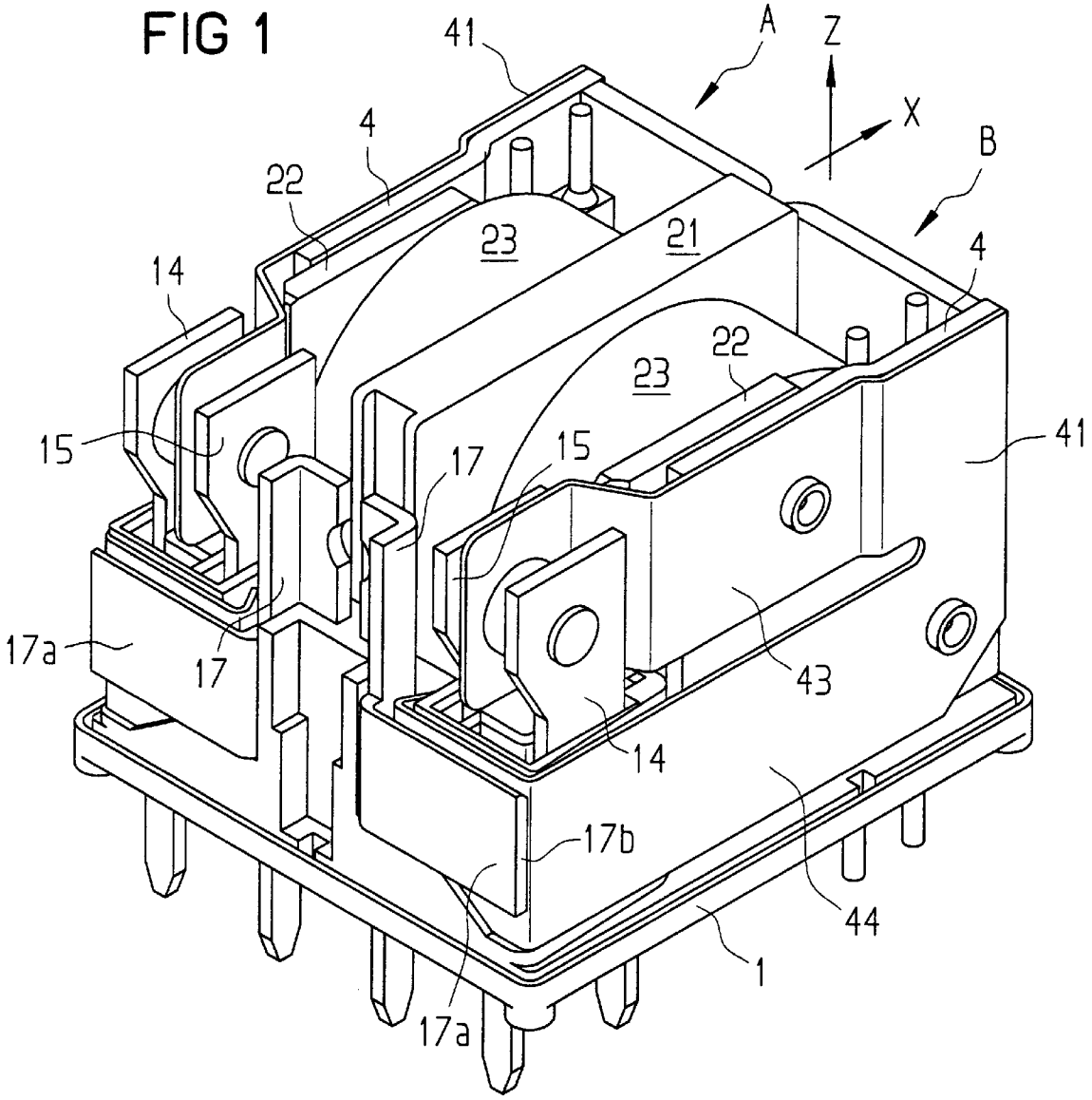
FIG. 1 is a perspective view of a double relay constructed in accordance with the present invention with the cover removed.
Figure 2:
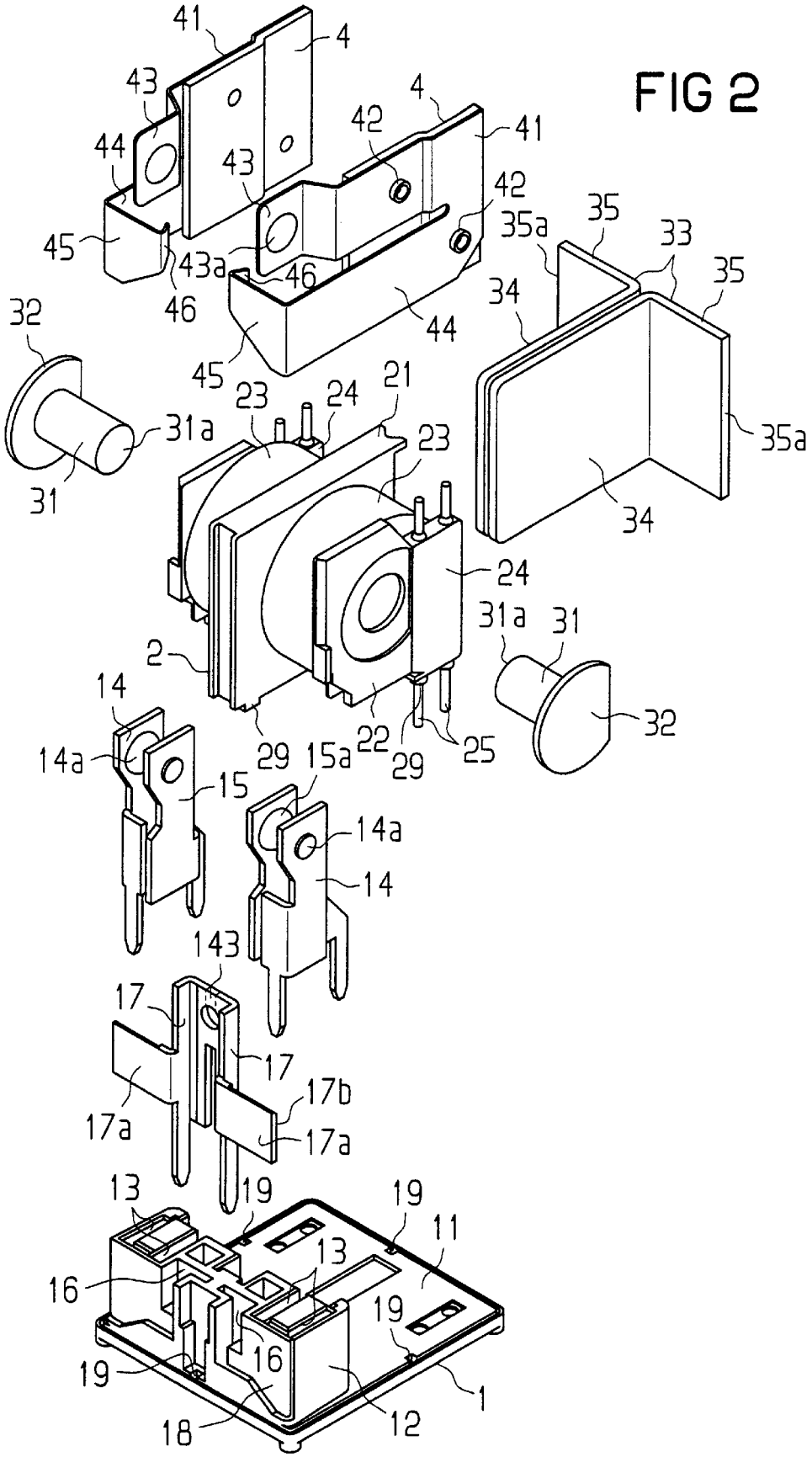
FIG. 2 is an exploded view of the relay of FIG. 1.

The relay shown in FIGS. 1 and 2 has a base 1 on which two switching systems A and B are arranged mirror-symmetrically to a plane of symmetry defined in FIG. 1 by the coordinates x and z. Because all parts in the two switching systems A and B are either mirror-symmetrically arranged or mirror-symmetrically fashioned, and have the same function, the same reference characters are used for both switching systems.

The base 1 is essentially fashioned as a flat plate that defines a base surface 11. a projection 12 is integrally formed on the surface 11, perpendicularly upward. The projection 12 is constructed in the manner of a labyrinth in order to form plugging channels 13 for two pairs of fixed contact carriers or bearers 14 and 15, as well as plugging channels 16 for two spring bearers 17. The fixed contact carriers 14, 15 and the spring carriers 17 respectively exit with terminal pins at the underside of the base 1. The fixed contact carrier 14 respectively bears a break contact 14*a*, while the fixed contact carrier 15 is provided with a make contact 15*a*. Each of the two spring bearers 17 has a soldering 17*a*, bent to the side.

A double coil body 2 is arranged on the base. It has a middle slotted flange 21 that lies in the plane of symmetry between the two switching systems, and two end flanges 22, whereby a winding 23 is arranged respectively between the middle flange and each of the end flanges. Each of the end flanges 22 has a flange projection 24 on the side turned away from the spring carriers 14 and 15. The projection 24 has two coil terminal pins 25 anchored therein. Within each winding 23, a core 31 with a pole flange or plate 32 is inserted into the coil bodies from the outside, so that the pole flange 32 lies partly in a recess of the end flange 22. Adjacent to the flange projection 24, the pole flange 32 is respectively cut at one side to accommodate the projection 24.

In addition, each switching system has an angled-off yoke 33 with a first yoke leg 34 and a second yoke leg 35, which both stand with their planes perpendicular to one another and perpendicular to the base side 11. The two first yoke legs 34 are inserted parallel to one another in a lateral opening or slot 26 of the middle flange 21 (see also FIG. 6). This opening 26 in the middle web has a circumferential middle web 27, by means of which a groove 28, circumferential on three sides, is formed for each of the yoke legs 34. Each yoke leg 34 is inserted into a groove 28 in the manner of a drawer. At the same time, the insulating distance between the two yoke limbs 34 is ensured by the thickness of the web 27.

An approximately plate-shaped armature 4 stands with its main plane likewise perpendicular to the base surface 11. In the present example, the armature 4 is slightly crimped in, only so as to fit the shape of the coil body. The armature 4 is positioned on the free terminating edge 35*a* of the second yoke limb 35, without being connected with the yoke via a positioning spring or the like. The armature 4, in turn, is connected to a contact spring 41, which lies laterally on the armature 4 with an end segment 41*a*, and is connected with the armature via one or two rivets 42. Proceeding from the end segment 41*a*, the contact spring 41 is split in the form of a fork in the direction toward the free amature end, and thus forms a contact leg 43 with a movable middle contact end 43*a* and a terminal leg 44. All segments of the crimped and bent contact spring 41 stand perpendicular to the base side 11, so that the contact leg 43 lies essentially above the terminal leg 44. On the terminal leg 44, a fastening segment 45 is bent away approximately perpendicularly. The fastening segment 45 bears a hook-shaped spring tab 46, bent inward, on its free end. The fastening segment 45 is inserted between a perpendicular insulating wall 18 of the base projection 12 on one side and the soldering tab 17*a* of the spring carrier 17. The fastening segment is clamped onto the projection 12 of the base 1 with the spring tab 46. Moreover, the soldering tab 17*a* is respectively conductively connected with the fastening segment 45, preferably by soldering or welding.

The functioning of the two switching systems of the double relay is self evident. Upon excitation of a coil 23, the associated armature 4 is drawn to the associated pole flange 32, whereby it switches the movable middle contact 43*a* over from the break contact 14*a* to the make contact 15*a* via the contact leg 43. The two switching systems can be actuated individually or together. Of course, it is also possible to use both switching systems together as a pole-reversal relay. In this case, the two spring bearers 17 could remain connected, as shown in FIG. 2, and the break contact bearer 14, as well as the make contact bearers 15, could respectively be externally interconnected.

In manufacturing a relay of the present invention, first the base 1 is equipped with the contact carriers. The fixed contact carriers 14 and 15 for both switching systems can thereby be simultaneously cut free in pairs from a strip and can be bent into their final shape. Preferably, both pairs of fixed contact carriers 14 and 15 are set into the base simultaneously and are only then separated. The two spring carriers 17 for the two switching systems are also preferably set into the base 1 in connected fashion, and are only subsequently separated from one another at the separation point 143.

Figure 3:
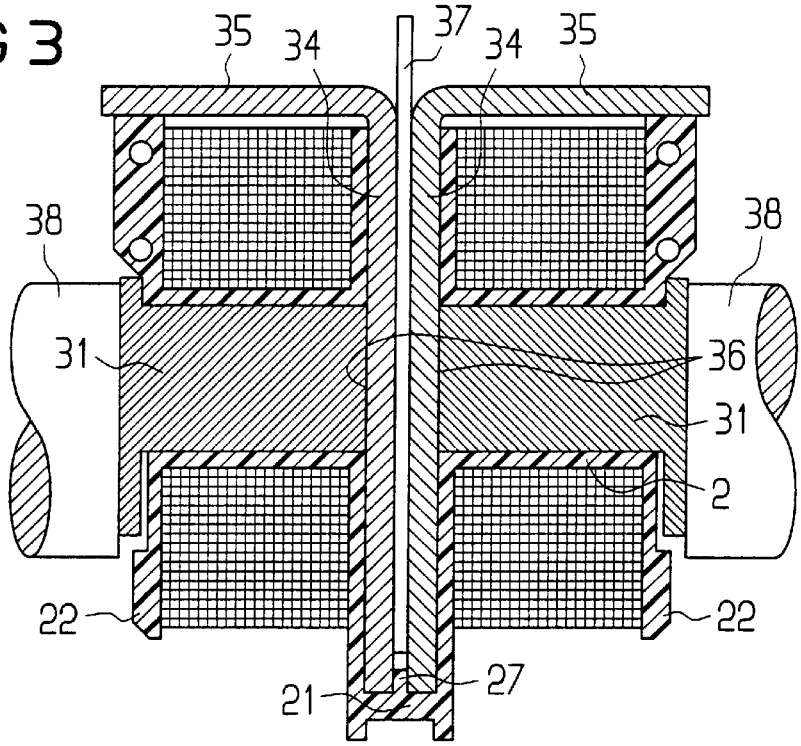
FIG. 3 is a longitudinal sectional view of the double relay illustrated in FIG. 1, with a schematically illustrated welding arrangement.

During the assembly of the two cores, they are inserted into the coil body 2, as shown in FIG. 3, so that the respective core lies with its inner frontal end 31*a* on the flat side of the yoke leg 34. A welding current is subsequently conducted through the yoke 33 and the core 31, which brings about a welding or a hard soldering of the two parts at the point of contact by means of resistance heating. During this hard soldering process, the copper surface coating of the core and/or the yoke, which is present in any case, serves as a hard solder. In this way, a practically gap-free connection results between the core and the yoke, whereby the magnetic resistance is minimized. The welding provided here of the core onto the yoke leg 34 is carried out to particular advantage when the yoke is made of a thin, space-saving sheet, for example having a thickness of <1 mm. The saturation values that are thereby effective for thin sheets likewise have a positive effect on the magnetic circuit.

This type of welding or soldering of the core 31 to the yoke 33 can be carried out in the relay of the present invention because the first yoke leg 34 is guided into the groove 28 of the middle flange 21 and is held in a stable position. Since the core 31 is held in the coil body 23, the connection point shown at 36 (see FIGS. 5 and 6) is not imposed with any leverage forces, so that the solder connection is not endangered. In addition, the two core-yoke connections can be produced at the same time. For this purpose, a contact sheet 37 as shown in FIG. 3 is introduced into the insulating gap between the two first yoke legs 34. The sheet 37 is connected with the one pole of the source of welding current. If the two cores are then connected in parallel with the other pole of the source of welding current via electrodes 38, the two connection points 36 can be simultaneously welded or hard-soldered. The contact sheet 37 is subsequently withdrawn from the slotted flange 21 of the double coil body 2. The double coil body 2, equipped with cores and yokes is positioned on the base, whereby mounting projections 29 on the slotted middle flange 21 snap into correspondingly undercut recesses 19 of the base.

The two armatures 4, with the contact springs 41 bent in a mirror image fashion, are set into the base 1 after the coil body 2, whereby the fastening segment 45 of the respective contact spring is inserted between the insulating wall 18 and the solder tab 17*a* and is clamped on the projection 12 of the base by means of the spring tab 46. The soldering tab 17*a* is preferably provided with a tin coating 17*b* on the side facing the fastening segment 45 so that this tab 17*a* can be soldered onto the fastening segment 45 of the contact spring 41 using a heat source, for example, by means of a TIG arc. however, a solder or welding connection by means of a laser or by means of another heat source is also be possible.

Since the free ends of the fixed contact carriers 14 and 15 with the fixed contacts 14*a* and 15*a* project beyond the terminal leg 44 or, respectively, the fastening segment 45 of the contact spring, they are easily accessible for a possibly required angle adjustment.

Figure 4:
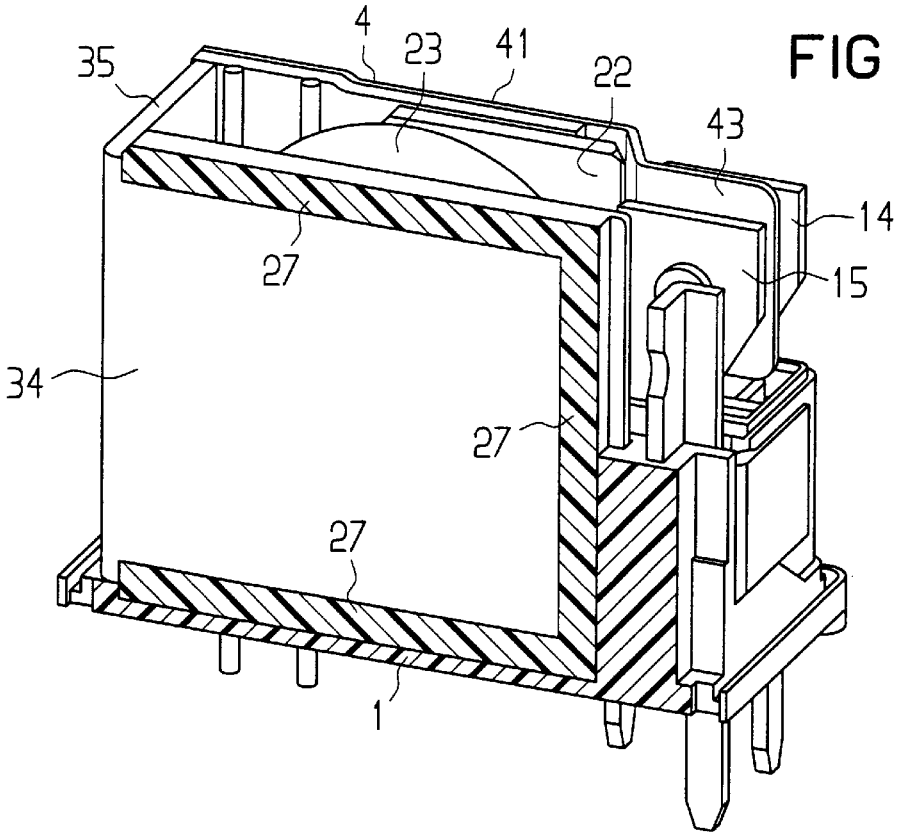
FIG. 4 is another sectional view through the relay of FIG. 1, along its mirror image plane.

As already stated above, the inventive construction can be implemented not only as a double relay but also as a single relay. For this purpose, the specified construction of the double relay need only split in half along the plane of mirror symmetry, as indicated in FIG. 1. FIG. 4 shows a section of this type. For the completion of the resulting single relay, it is necessary only to fit the halved base and the halved coil body on the side of the cut, so that, with a housing cover that likewise comprises half the size, the closed single relay results. The remaining parts can also be used in unaltered form for the single relay, so that a separate specification would be superfluous.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. An electromagnetic relay comprising:

a base comprising a bottom surface accommodating a first switch, the first switch comprising a coil body comprising a coil disposed between a first flange and a second flange, the coil body further comprising an axial core, the first flange including a slot for accommodating a first leg of a yoke, the core having an outer end and an inner end, the core extending through the coil of the coil body, the inner end of the core being attached to the first yoke leg, the yoke including a second leg that extends next to the coil and terminates at a free end that engages an armature, the armature extending alongside but spaced from the outer end of the core to form a gap between the armature and the outer end of the core, the first leg of the yoke is frictionally secured against motion within the slot of the first flange, and a second switch characterized as being a mirror image of the first switch and disposed in a mirror image relationship with respect to the first switch, the first and second switches being connected at their respective first flanges so that the first yoke leg of the first switch is parallel to the first yoke leg of the second switch with an insulating spacing disposed therebetween.

2. The relay of claim 1 wherein the first yoke leg is disposed perpendicular to a central axis of the core.

3. The relay of claim 1 wherein the slot of the first flange comprises at least one edge, the first yoke leg comprises at least one edge, the first yoke leg being secured within the slot by engagement against a web extending along at least one edge of the slot and along at least one edge of the first yoke leg.

4. The relay of claim 1 wherein the slot of the first flange comprises three edges including an upper edge, a lower edge and a back edge, the first yoke leg is secured within the slot by engagement against a web extending along the upper edge, the lower edge and the back edge of slot.

5. The relay of claim 1 wherein the inner end of the core is soldered to the first yoke leg.

6. The relay of claim 1 wherein the inner end of the core is welded to the first yoke leg.

7. The relay of claim 1 wherein the coil of the first switch is aligned with the coil of the second switch.

8. The relay of claim 1 wherein the coil body of the first switch and the coil body of the second switch are formed by means of a one-piece double coil body whereby the first flange of the first switch is connected to the first flange of the second switch to form a common middle flange, and whereby the second flange of the first switch and the second flange of the second switch are disposed on opposing ends of base.

9. The relay of claim 8 wherein the first yoke leg of the first switch and the first yoke leg of the second switch are secured in the middle flange and are separated from one another by an insulating web.

10. A double relay comprising a first switch and a second switch, second switch disposed in a mirror image relationship with respect to the first switch, the relay further comprising a double coil body comprising a slotted common middle flange disposed between a first end flange and a second end flange, the first switch comprising a first coil body disposed between the middle flange and a first end flange, the first coil body comprising a first coil and a first core extending through the first coil, the middle flange including a slot for accommodating a leg of a first yoke, the first core having an outer end and an inner end, the inner end of the first core being attached to the leg of the first yoke, the leg of the first yoke is frictionally secured against motion within the slot of the middle flange, the second switch comprising a second coil body disposed between the middle flange and a second end flange, the second coil body comprising a second coil and a second core extending through the second coil, the middle flange including a second slot for accommodating a leg of a second yoke, the second core having an outer end and an inner end, the inner end of the second core being attached to the leg of the second yoke, the leg of the second yoke is frictionally secured against motion within the slot of the middle flange.

11. The double relay of claim 10 wherein the leg of the first yoke is parallel to the leg of the second yoke with an insulating spacing disposed therebetween.

12. The double relay of claim 10 wherein the first coil is axially aligned with the second coil.

13. The relay of claim 10 wherein the leg of the first yoke and the leg of the second yoke are secured in the middle flange and are separated from one another by an insulating web.

* * * * *